US009173499B2

(12) United States Patent
Baas et al.

(10) Patent No.: US 9,173,499 B2
(45) Date of Patent: Nov. 3, 2015

(54) ADJUSTABLE ARMREST APPARATUS

(71) Applicant: Royal Technologies Corporation, Hudsonville, MI (US)

(72) Inventors: James Henry Baas, Holland, MI (US); Wesley D. Mersman, Holland, MI (US)

(73) Assignee: Royal Technologies Corporation, Hudsonville, MI (US)

( * ) Notice: Subject to any disclaimer, the term of this patent is extended or adjusted under 35 U.S.C. 154(b) by 0 days.

(21) Appl. No.: 14/336,306

(22) Filed: Jul. 21, 2014

(65) Prior Publication Data

US 2015/0028645 A1 Jan. 29, 2015

Related U.S. Application Data

(60) Provisional application No. 61/856,653, filed on Jul. 19, 2013.

(51) Int. Cl.
*A47C 7/54* (2006.01)
*A47C 1/03* (2006.01)

(52) U.S. Cl.
CPC .... *A47C 7/54* (2013.01); *A47C 1/03* (2013.01)

(58) Field of Classification Search
CPC ..... A47C 7/54; A47C 1/03
USPC ..... 297/411.35, 411.37, 411.38
See application file for complete search history.

(56) References Cited

U.S. PATENT DOCUMENTS

| | | | | |
|---|---|---|---|---|
| 4,277,102 | A * | 7/1981 | Aaras et al. | 297/411.36 |
| 5,884,975 | A * | 3/1999 | Su | 297/411.35 |
| 7,862,123 | B2 * | 1/2011 | Baker et al. | 297/411.35 X |
| 2002/0109387 | A1 * | 8/2002 | Noiseux | 297/411.37 |
| 2008/0138149 | A1 * | 6/2008 | Selbekk et al. | 403/24 |

FOREIGN PATENT DOCUMENTS

| | | | | |
|---|---|---|---|---|
| DE | 10045863 | A1 * | 3/2002 | A47C 7/54 |

* cited by examiner

*Primary Examiner* — Rodney B White
(74) *Attorney, Agent, or Firm* — The Watson I.P. Group, PLC; Jovan N. Jovanovic; Vladan M. Vasiljevic

(57) ABSTRACT

An adjustable armrest having a base and an armrest that are coupled together through an articulating joint assembly. The joint assembly includes a body with a first articulating ball joint and a second articulating ball joint. The first articulating ball joint is coupled to the armrest with the second articulating ball joint being coupled to the base.

19 Claims, 4 Drawing Sheets

ADJUSTABLE ARMREST APPARATUS

CROSS-REFERENCE TO RELATED APPLICATION

This application claims priority from U.S. Provisional Patent Application Ser. No. 61/856,653 filed Jul. 19, 2014, entitled "Adjustable Armrest Apparatus," the entire specification of which is hereby incorporated by reference in its entirety.

BACKGROUND OF THE DISCLOSURE

1. Field of the Disclosure

The disclosure relates in general to chair components, and more particularly, to adjustable armrest apparatuses which can be adjustable relative to the remainder of the chair. The adjustment mechanisms improve the interaction, movement and/or range of adjustment of an armrest.

2. Background Art

Over the past years, there has been a renewed focus on affording improved comfort to users of chairs and, in particular, office chairs. It is known that users sit in such chairs for many hours per day. Thus, even a slight improvement in posture, comfort and ease of use greatly improves the user experience. In addition, such improvements in user experience can minimize injury, enhance comfort and improve productivity.

Among other areas of focus, the armrest has been a focal point of improvement. Newer standards are being adopted which impose new requirements on armrests for office chairs. Such requirements include an increase in the range of adjustment in multiple directions.

There are many adjustable armrests that include adjustment capabilities toward and away from the back rest, toward and away from each other and also rotative capabilities. There is a need to provide a greater range of movement in each of those directions, as well as to improve the mechanisms used to achieve such movement. For example, current examples typically have limitations that include difficulty of use, difficulty of assembly, difficulty of configuration. Often the adjustment structures are also quite cumbersome and detract from an otherwise sleek chair design.

SUMMARY OF THE DISCLOSURE

In one aspect of the disclosure, the disclosure is directed to an adjustable armrest apparatus. The apparatus comprises a base, an armrest and an articulating joint assembly. The base is configured to be attached to a chair. The armrest is spaced apart from the base. The articulating joint assembly has a body, a first articulating ball joint and a lower socket limiting member. The body has a first end and a second end and defining a cavity at the first end.

The first articulating ball joint is at the first end. The first articulating ball joint comprises a lower socket member, a ball member and an upper socket member. The lower socket member is slidably positionable within the cavity of the body proximate the first end. The lower socket member includes a ball contact surface facing outwardly from the cavity and an opposing surface facing in a direction opposite of the ball contact surface. The ball member includes an outer surface and a coupling member. The ball member is positionable within the cavity on the ball contact surface of the lower socket member. The upper socket member is fixedly coupled to the articulating joint and has a ball contact surface which engages the ball member, and confines the ball member between the upper socket member and the lower socket member. The upper socket member includes an opening extending therethrough for access to the coupling member of the ball member.

The lower socket limiting member is positioned within the body and biasing the lower socket member toward the upper socket member so as to sandwich the ball member therebetween and to increase the force necessary to rotate the ball member.

The base is coupled to one of the coupling member of the ball member at the first end and the second end of the articulating joint assembly. The armrest is coupled to the other of the coupling member of the ball member at the first end and the second end.

In a preferred embodiment, the armrest is coupled to the coupling member of the ball member at the first end of the articulating joint assembly. The articulating joint assembly further comprising a second articulating ball joint. The second articulating ball joint comprises a second lower socket member, a second ball member, and a second upper socket member. The second lower socket member is slidably positionable within the cavity of the body proximate the second end. The second lower socket member includes a ball contact surface facing outwardly from the cavity and an opposing surface facing in a direction opposite of the ball contact surface. The second ball member includes an outer surface and a coupling member. The second ball member is positionable within the cavity on the ball contact surface of the second lower socket member. The second upper socket member is fixedly coupled to the articulating joint and has a ball contact surface which engages the ball member, and confines the ball member between the second upper socket member and the second lower socket member. The second upper socket member includes an opening extending therethrough for access to the coupling member of the second ball member.

The second lower socket limiting member is positioned within the body and biasing the second lower socket member toward the second upper socket member so as to sandwich the second ball member therebetween and to increase the force necessary to rotate the second ball member.

The base is coupled to the coupling member of the second ball member.

In some configurations, the lower socket limiting member and the second lower socket limiting member comprise a single integrally formed spring.

In some configurations, the single integrally formed spring comprises a coil spring.

In some configurations, the opposing surface of the lower socket limiting member includes an upstand portion and a base seat. The upstand portion provides a guide to the coil spring. The base seat providing a base upon which the coil spring can act upon (i.e., creating a cavity for receipt of the coil spring).

In some configurations, the opposing surface of the second lower socket limiting member includes an upstand portion and a base seat. The upstand portion provides a guide to the coil spring, and the base seat provides a base upon which the coil spring can act upon.

In some configurations, the upper socket member is threadedly coupled to the first end of the body of the articulating joint assembly.

In some configurations, the upper socket member further includes a pair of outward arms. The arms are configured to facilitate the threaded engagement of the upper socket member to the articulating joint assembly, and, in turn, the effect of the biasing member on the ball member.

In some configurations, the upper socket member of the first articulating ball joint is threadedly coupled to the first end of the body of the articulating joint assembly. The upper socket member of the second articulating ball joint is threadedly coupled to the second end of the body of the articulating joint assembly.

In some configurations, the coupling member of the ball member comprises a threaded fastener.

In some configurations, the coupling member of the ball member comprises a threaded fastener. The coupling member of the second ball member comprises a threaded fastener.

In some configurations, the body of the articulating joint assembly comprises an elongated tubular member having a substantially circular cross-sectional configuration.

In some configurations, the coupling member of the ball member is coupled to a mounting surface of the armrest.

In some configurations, the mounting surface is on an opposite side of an armresting surface.

In another aspect of the disclosure, the disclosure is directed to an adjustable armrest apparatus comprising a base, an armrest and an articulating joint assembly. The base is configured to be attached to a chair. The armrest is spaced apart from the base. The articulating joint assembly has a body, a first articulating ball joint, a second articulating ball joint, and a lower socket limiting member. The body has a first end and a second end and defining a cavity therebetween. The first articulating ball joint is positioned at the first end. The second articulating ball joint is positioned at the second end. Each articulating ball joint comprises a lower socket member, a ball member and an upper socket member. The lower socket member is slidably positionable within the cavity of the body positioned at the respective end of the body. The lower socket member includes a ball contact surface facing outwardly from the cavity and an opposing surface facing in a direction opposite of the ball contact surface. The ball member includes an outer surface and a coupling member. The ball member is positioned within the cavity on the ball contact surface of the lower socket member. The upper socket member is fixedly coupled to the articulating joint. The upper socket member has a ball contact surface which engages the ball member, and confines the ball member between the upper socket member and the lower socket member. The upper socket member includes an opening extending therethrough for access to the coupling member of the ball member.

The lower socket limiting member is positioned within the body and biases the lower socket member of each of the first and second articulating ball joints in opposing directions. That is, the member biases the lower socket members toward the respective upper socket member so as to sandwich each ball member therebetween and to increase the force necessary to rotate each ball member.

In such a configuration, the ball member of the first articulating ball joint is coupled to the armrest and the second articulating ball joint is coupled to the base.

In some configurations the upper socket member of each of the first and second articulating ball joints is threadedly coupled to the respective one of the first end of the body of the articulating joint assembly or the second end of the body of the articulating joint assembly.

In some configurations, at least one of the upper socket member of the first articulating ball joint and the upper socket member of the second articulating ball joint has a pair of outward arms. The arms are configured to facilitate the threaded engagement of the upper socket member to the body of the articulating joint assembly, and, in turn, the effect of the biasing member on the ball member.

In some configurations, the lower socket limiting member comprises a spring having a pair of opposing ends. The opposing surface of each of the lower socket members includes an upstand portion and a base seat, defining a cavity for receipt of each of the pair of opposing ends of the spring.

In some configurations, the body of the articulating joint assembly comprises an elongated tubular member having a substantially circular cross-sectional configuration.

BRIEF DESCRIPTION OF THE DRAWINGS

The disclosure will now be described with reference to the drawings wherein.

DETAILED DESCRIPTION OF THE DISCLOSURE

Figure 1:
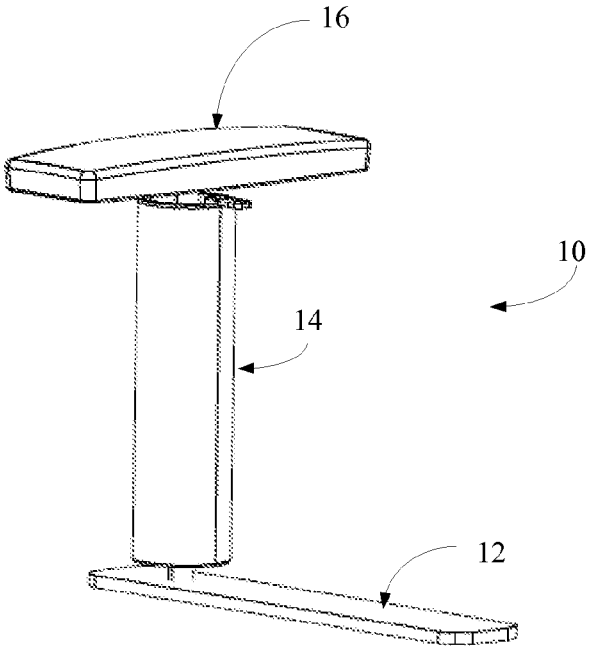
FIG. 1 of the drawings is a perspective view of the adjustable armrest of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
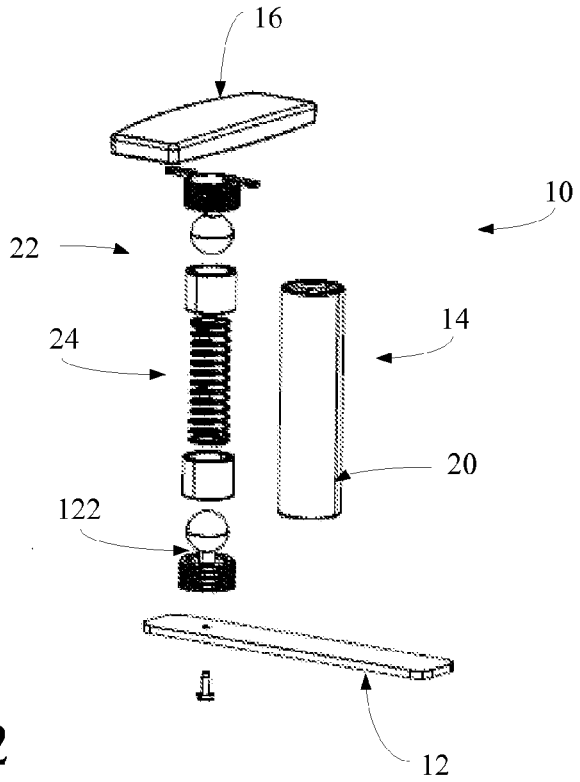
FIG. 2 of the drawings is an exploded perspective view of the adjustable armrest of the present disclosure.

Referring now to the drawings and in particular to FIGS. 1 and 2, the adjustable armrest assembly is shown generally at 10. The adjustable armrest assembly includes base 12, articulating joint assembly 14, and armrest 16. The articulating joint assembly 14 is configured to couple to the base 12 at a first end and to the armrest 16 at the second end.

Figure 3:
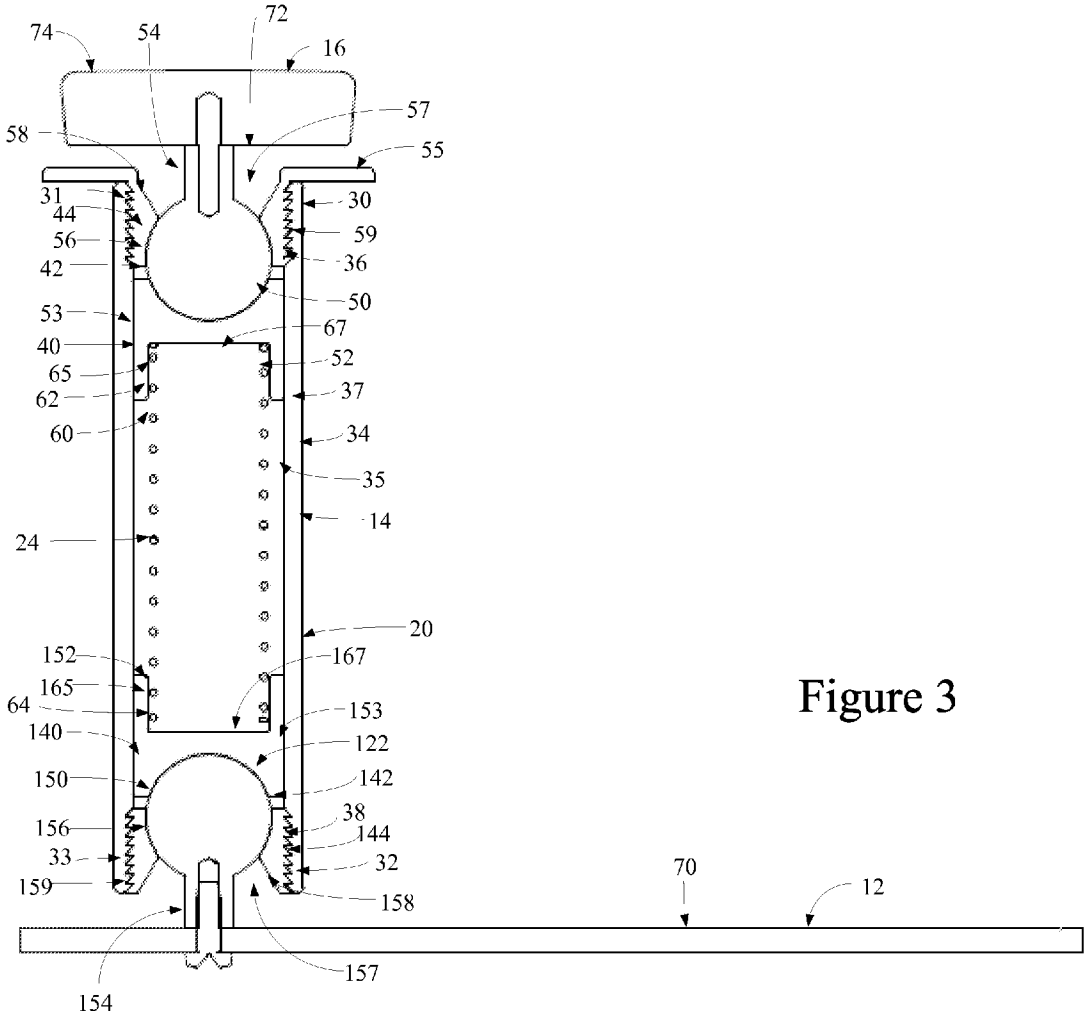
FIG. 3 of the drawings is a cross-sectional view of the adjustable armrest of the present disclosure.

The base 12 is coupled to a chair, such as an office chair. For example, the base 12 may be coupled to the base of the chair, the seating surface of the chair or the backrest of the chair. The foregoing are merely examples, and the disclosure is not limited to any particular coupling of the base to any particular member of the chair. With reference to FIG. 3, the base 12 includes a mounting surface 70 which is configured to receive and retain the articulating joint assembly.

Figure 6:
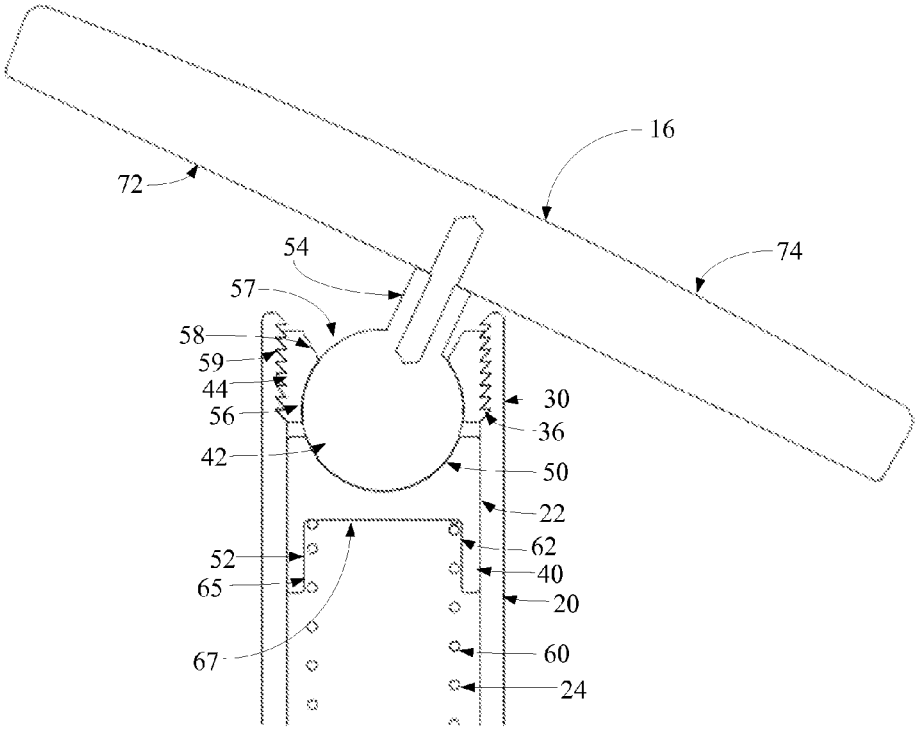
FIG. 6 of the drawings is a partial perspective view of the adjustable armrest of the present disclosure, showing, in particular, the armrest in an articulated configuration.

The armrest 16 is shown in FIGS. 3 and 6 as comprising an armresting surface 74 and a mounting surface 72. In the embodiment shown, the two surfaces are on opposite sides of each other, however, it will be understood that this is merely exemplary. In other embodiments, the two may be positioned on adjacent surfaces. The armresting surface is generally the outward surface and may include padding and the like for comfort to the user. The mounting surface may comprise a polymer member or a metal member, or a combination (i.e., a metal insert in a polymer molded member). Of course other materials are likewise contemplated.

The articulating joint assembly 14 is shown in FIG. 2 as comprising body 20, first articulating ball joint 22, second articulating ball joint 122 and lower socket limiting member 24. The articulating joint assembly 14 is shown as having a particular length, however, it will be understood that the length shown is merely exemplary and any number of different configurations are contemplated for use.

With further reference to FIG. 3, the body 20 extends from first end 30 to second end 32, and comprises a generally tubular member 34. The tubular member 34 includes inner surface 35 and outer surface 37 and defines a generally uniformly cylindrical member having a substantially circular cross-sectional configuration. In other embodiments, the tubular member may comprise a member having a non-linear configuration (such as an L-shaped member which extends from a backrest, or a member which includes bends and the like to accommodate different portions of furniture). In other embodiments, the tubular member may comprise two end cavities with a connector therebetween which may be of a configuration which is substantially different than the end cavities. It is also contemplated that the length of the body may be adjustable, for example, in the form of a telescoping section, or otherwise, such that the length can be adjusted in opposing directions. In the embodiment wherein the body comprises a generally L-shaped portion, the body may be height or length adjustable, wherein the locking structural buttress support member could be used to connect between the back and the underside of the arm. This would preclude the arm from moving downward when locked and when loaded.

A first threaded end 31 is positioned on the inner surface 35 at the first end 30. Similarly, a second threaded end 33 is positioned on the inner surface 35 at the second end 32. It will be understood that in other embodiments, other fastening means may be employed, as well as positioning of the threaded portion may be on an outer surface at one or both ends.

First articulating ball joint 22 is shown in FIG. 2. It will be understood that the two ball joints, 22, 122 are substantially identical, and, each will be discussed in turn. It will also be understood that the two joints may be different, or that only a single joint may be presented on a particular embodiment.

The first articulating ball joint 22 comprises lower socket member 40, ball member 42 and upper socket member 44. The lower socket member 40 includes ball contact surface 50, opposing surface 52 and outer circumferential surface 53. It will be understood that the lower socket member is slidably positionable and movable within the inner surface 35 of the tubular member proximate the first end 30 thereof, with generally tight tolerances. Generally, the lower socket member comprises a tubular member. The opposing surface of the lower socket member includes an upstand portion 65 and a base seat 67, defining a cavity for receipt of each of the pair of opposing ends of the spring.

The ball member 42 comprises a generally spherical member having an outer surface which can be positioned within the inner surface 35 of the tubular member with little interference therewith. A coupling member 54 extends outwardly from the ball member. In the embodiment shown, the coupling member comprises a cylindrical member that extends generally perpendicularly from the surface of the ball member, and which includes an inner threaded opening extending therethrough. Of course other coupling members are likewise contemplated, including, but not limited to any one of a number of different attachment members (such as openings extending into the ball member), pin members and otherwise. The coupling member provides the interference with the upper socket member to preclude further rotation (i.e., to form a stop).

Figure 4:
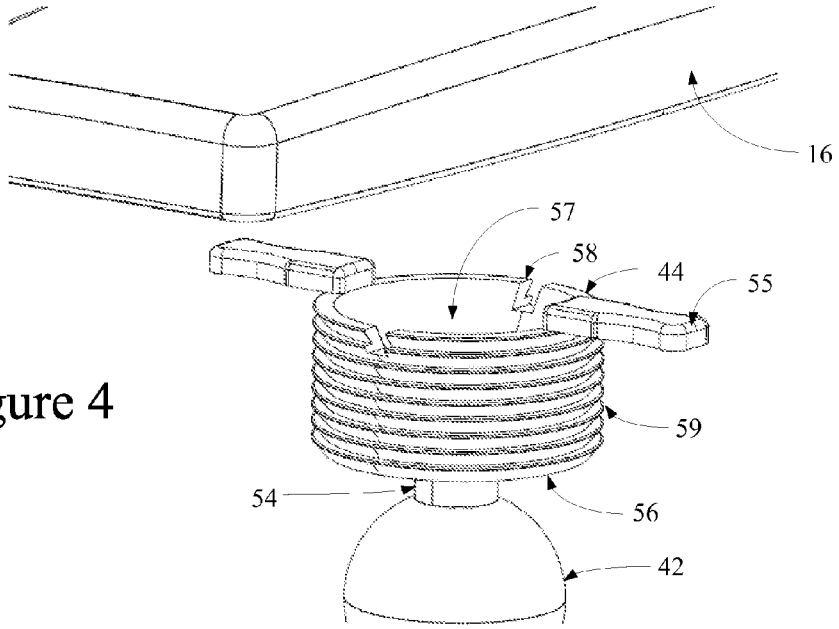
FIG. 4 of the drawings is a partial exploded perspective view of the adjustable armrest of the present disclosure, showing in particular, the first articulating joint.
Figure 5:
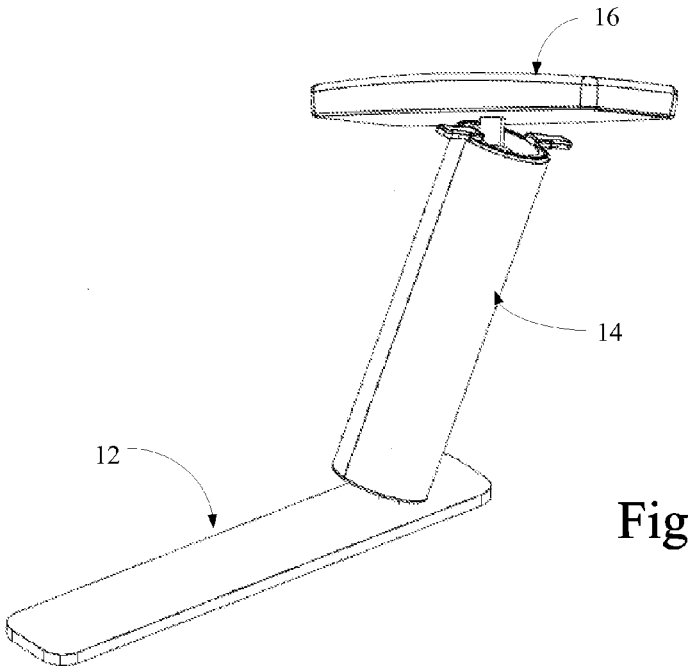
FIG. 5 of the drawings is a perspective view of the adjustable armrest of the present disclosure, showing, in particular, an articulated configuration of the same.

With additional reference to FIG. 4, the upper socket member 44 includes inner ball contact surface 56, outward surface 58 and circumferential surface 59. An opening 57 extends through the upper socket member which is generally centrally located. It will be understood that this opening may be used to define the range of motion of the ball member through the interaction of the coupling member 54 with the outer circumference of the opening. Under heavy loading, the arm is designed to stay within these limits, as they provide a hard stop.

Additionally, the circumferential surface 59 includes threads which are configured to matingly engage the threads on the first threaded end 36 of the tubular member. To facilitate coupling of the two structures, arms 55 may be provided which extend outwardly from the circumferential surface at the outward surface. The arms provide a convenient manner to rotate the upper socket member relative to the body 20, and provide increased leverage. In addition, it will be understood that further inward rotation of the upper socket member increases the force against the spring, and in turn, the resistance of the assembly to preclude the rotation of the ball member. Advantageously, with a single spring, the threading of one of the two upper socket members can increase the spring force toward both.

With reference to FIG. 3, the second articulating ball joint 122 is generally identical to the first articulating ball joint, however variations are contemplated. In particular, the second articulating ball joint 122 comprises lower socket member 140, ball member 142 and upper socket member 144. The lower socket member 140 includes ball contact surface 150, opposing surface 152 and outer circumferential surface 153. It will be understood that the lower socket member is slidably positionable and movable within the inner surface 35 of the tubular member proximate the second end 32 thereof, with generally tight tolerances. Generally, the second lower socket member also comprises a tubular member. The opposing surface of the lower socket member includes an upstand portion 165 and a base seat 167, defining a cavity for receipt of each of the pair of opposing ends of the spring.

The ball member 142 comprises a generally spherical member having an outer surface which can be positioned within the inner surface 35 of the tubular member with little interference therewith. A coupling member 154 extends outwardly from the ball member. In the embodiment shown, the coupling member comprises a cylindrical member that extends generally perpendicularly from the surface of the ball member, and which includes an inner threaded opening extending therethrough. Of course other coupling members are likewise contemplated, including, but not limited to any one of a number of different attachment members (such as openings extending into the ball member), pin members and otherwise.

The upper socket member 144 includes inner ball contact surface 156, outward surface 158 and circumferential surface 159. An opening 157 extends through the upper socket member which is generally centrally located. It will be understood that this opening may be used to define the range of motion of the ball member through the interaction of the coupling member 154 with the outer circumference of the opening. Additionally, the circumferential surface 159 includes threads which are configured to matingly engage the threads on the second threaded end 38 of the tubular member.

The lower socket limiting member 24 is shown as comprising biasing spring 60. The biasing spring 60 includes first end 62 and second end 64. The spring is configured so as to have a length that is close to the length of the tubular member. The spring member is configured to interface with the opposing surface 52 of the lower socket member 40 at the first end 62 and the opposing surface 152 of the lower socket member 140 at the second end 64. A coil spring is shown, however, other arrangements are contemplated, including, but not limited to leaf springs and the like.

To assemble the apparatus, it is necessary to assemble the articulating joint assembly 14. While certain methods will be disclosed, they are not to be deemed limiting, and any number of different methods may be used. As such, they are more illustrative in nature.

More specifically, the body is first provided. Subsequently, the first articulating ball joint can be formed. The same is formed through the positioning of the lower socket member into the tubular member, which is achieved through slidable engagement through the opening at the second end. As the lower socket member is directed to the first articulating ball joint, the ball member is dropped through the opening at the first end 30 and then the upper socket member is threadingly engaged to the threaded end at the first end.

Once the first articulating ball joint is completed, the biasing spring 60 can be inserted into the opening at the second end 32 of the body 20. Once inserted, the lower socket member 140 of the second articulating ball joint 122 is inserted so that the opposing surface abuts the second end 64 of the biasing spring. Once positioned, the ball member 142 can be positioned upon the ball contact surface 150 of the lower socket member 140. Finally, the upper socket member 44 can be threadingly engaged with the second threaded end 38 at the second end.

Once assembled, the upper socket member 44 of the first articulating ball joint 22 and the upper socket member 144 of the second articulating ball joint 122 can be selectively rotated relative to the body to either direct them further into or further out of the respective end of the body. It will be understood that the biasing spring controls the amount of tension between the ball members and the respective upper and lower socket members. That is, as the distance between the upper socket members is changed by the user, the spring is compressed, and the force against the ball members increases.

The base can be coupled to the second end of the articulating joint assembly by a fastener that extends through the mounting surface and into the coupling member 154 of the ball member 142. Similarly, the armrest can be coupled to the articulating joint assembly at the first end by extending a fastener through the armrest and into the coupling member 54 of the ball member 42.

It will be understood that variations are contemplated. Among other variations, and by no means are the variations limited to the foregoing, in the place of the spring, an internal flange can limit the position of the lower socket members 40, 140. As such, the lower socket members are generally fixed, and, the force exerted by the socket members on the ball member can be based entirely on the position of the upper socket members. In another embodiment, a clamping mechanism could be utilized (analogous to a bike wheel spanner quick release). As another variation, the coupling members 54, 154 of the ball members could be formed with the base and the armrest, with a means by which to attach the same to the ball members.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. An adjustable armrest apparatus comprising:

a base configured to be attached to a chair;

an armrest spaced apart from the base; and an articulating joint assembly having:

a body with a first end and a second end and defining a cavity at the first end;

a first articulating ball joint at the first end, the first articulating ball joint comprising:

a lower socket member slidably positionable within the cavity of the body proximate the first end, the lower socket member including a ball contact surface facing outwardly from the cavity and an opposing surface facing in a direction opposite of the ball contact surface;

a ball member including an outer surface and a coupling member, the ball member positionable within the cavity on the ball contact surface of the lower socket member; and an upper socket member fixedly coupled to the articulating joint and having a ball contact surface which engages the ball member, and confines the ball member between the upper socket member and the lower socket member, the upper socket member including an opening extending therethrough for access to the coupling member of the ball member; and a lower socket limiting member positioned within the body and biasing the lower socket member toward the upper socket member so as to sandwich the ball member therebetween and to increase the force necessary to rotate the ball member;

wherein the base is coupled to one of the coupling member of the ball member at the first end and the second end of the articulating joint assembly and the armrest is coupled to the other of the coupling member of the ball member at the first end and the second end.

2. The adjustable armrest apparatus of claim 1 wherein the armrest is coupled to the coupling member of the ball member at the first end of the articulating joint assembly, the articulating joint assembly further comprising:

a second articulating ball joint comprising:

a second lower socket member slidably positionable within the cavity of the body proximate the second end, the second lower socket member including a ball contact surface facing outwardly from the cavity and an opposing surface facing in a direction opposite of the ball contact surface;

a second ball member including an outer surface and a coupling member, the second ball member positionable within the cavity on the ball contact surface of the second lower socket member; and a second upper socket member fixedly coupled to the articulating joint and having a ball contact surface which engages the ball member, and confines the ball member between the second upper socket member and the second lower socket member, the second upper socket member including an opening extending therethrough for access to the coupling member of the second ball member; and a second lower socket limiting member positioned within the body and biasing the second lower socket member toward the second upper socket member so as to sandwich the second ball member therebetween and to increase the force necessary to rotate the second ball member, wherein the base is coupled to the coupling member of the second ball member.

3. The adjustable armrest apparatus of claim 2 wherein the upper socket member of the first articulating ball joint is threadedly coupled to the first end of the body of the articulating joint assembly and the upper socket member of the second articulating ball joint is threadedly coupled to the second end of the body of the articulating joint assembly.

4. The adjustable armrest apparatus of claim 2 wherein the coupling member of the ball member comprises a threaded fastener, and the coupling member of the second ball member comprises a threaded fastener.

5. The adjustable armrest apparatus of claim 2 wherein the lower socket limiting member and the second lower socket limiting member comprise a single integrally formed spring.

6. The adjustable armrest apparatus of claim 5 wherein the single integrally formed spring comprises a coil spring.

7. The adjustable armrest apparatus of claim 5 wherein the opposing surface of the lower socket limiting member includes an upstand portion and a base seat, the upstand portion providing a guide to the coil spring, and the base seat providing a base upon which the coil spring can act upon.

8. The adjustable armrest apparatus of claim 7 wherein the opposing surface of the second lower socket limiting member includes an upstand portion and a base seat, the upstand portion providing a guide to the coil spring, and the base seat providing a base upon which the coil spring can act upon.

9. The adjustable armrest apparatus of claim 1 wherein the upper socket member is threadedly coupled to the first end of the body of the articulating joint assembly.

10. The adjustable armrest apparatus of claim 9 wherein the upper socket member further includes a pair of outward arms, wherein the arms are configured to facilitate the threaded engagement of the upper socket member to the articulating joint assembly, and, in turn, the effect of the biasing member on the ball member.

11. The adjustable armrest apparatus of claim 1 wherein the coupling member of the ball member comprises a threaded fastener.

12. The adjustable armrest apparatus of claim 1 wherein the body of the articulating joint assembly comprises an elongated tubular member having a substantially circular cross-sectional configuration.

13. The adjustable armrest apparatus of claim 1 wherein the coupling member of the ball member is coupled to a mounting surface of the armrest.

14. The adjustable armrest apparatus of claim 13 wherein the mounting surface is on an opposite side of an armresting surface.

15. An adjustable armrest apparatus comprising:

a base configured to be attached to a chair;

an armrest spaced apart from the base; and an articulating joint assembly having:

a body with a first end and a second end and defining a cavity therebetween;

a first articulating ball joint at the first end and a second articulating ball joint at the second end, each articulating ball joint comprising:

a lower socket member slidably positionable within the cavity of the body positioned at the respective end of the body, the lower socket member including a ball contact surface facing outwardly from the cavity and an opposing surface facing in a direction opposite of the ball contact surface;

a ball member including an outer surface and a coupling member, the ball member positionable within the cavity on the ball contact surface of the lower socket member; and an upper socket member fixedly coupled to the articulating joint and having a ball contact surface which engages the ball member, and confines the ball member between the upper socket member and the lower socket member, the upper socket member including an opening extending therethrough for access to the coupling member of the ball member; and a lower socket limiting member positioned within the body and biasing the lower socket member of each of the first and second articulating ball joints in opposing directions, toward the respective upper socket member so as to sandwich each ball member therebetween and to increase the force necessary to rotate each ball member;

wherein the ball member of the first articulating ball joint is coupled to the armrest and the second articulating ball joint is coupled to the base.

16. The adjustable armrest apparatus of claim 15 wherein the upper socket member of each of the first and second articulating ball joints is threadedly coupled to the respective one of the first end of the body of the articulating joint assembly or the second end of the body of the articulating joint assembly.

17. The adjustable armrest apparatus of claim 16 wherein at least one of the upper socket member of the first articulating ball joint and the upper socket member of the second articulating ball joint having a pair of outward arms, wherein the arms are configured to facilitate the threaded engagement of the upper socket member to the body of the articulating joint assembly, and, in turn, the effect of the biasing member on the ball member.

18. The adjustable armrest apparatus of claim 15 wherein the lower socket limiting member comprises a spring having a pair of opposing ends, the opposing surface of each of the lower socket members includes an upstand portion and a base seat, defining a cavity for receipt of each of the pair of opposing ends of the spring.

19. The adjustable armrest apparatus of claim 18 wherein the body of the articulating joint assembly comprises an elongated tubular member having a substantially circular cross-sectional configuration.

* * * * *